United States Patent [19]

Klingman

[11] 4,157,199

[45] Jun. 5, 1979

[54] APPARATUS FOR RETRIEVING A TUBULAR MEMBER FROM A WELL

[75] Inventor: Robert C. Klingman, Houma, La.

[73] Assignee: Wilson Industries, Houston, Tex.

[21] Appl. No.: 821,462

[22] Filed: Aug. 3, 1977

[51] Int. Cl.[2] ..... E21B 31/00

[52] U.S. Cl. ..... 294/86.29; 294/86.18; 294/86.1; 294/86.22; 294/86.25

[58] Field of Search ..... 294/86.29, 86.18, 86.1, 294/86.22, 86.23, 86.25, 86.28, 86.3; 166/55.6, 55, 55.8, 298

[56] References Cited

U.S. PATENT DOCUMENTS

| | | | |
|---|---|---|---|
| 2,103,611 | 12/1937 | Catland et al. | 294/86.29 |
| 2,277,580 | 3/1942 | Carothers | 166/55.6 |
| 3,174,548 | 3/1965 | Webb | 294/86.29 |

*Primary Examiner*—James B. Marbert

*Attorney, Agent, or Firm*—George M. Medwick

[57] ABSTRACT

Apparatus for grasping the exterior surface of a tubular member to facilitate removal thereof from within a well is characterized by a substantially hollow, elongated housing having first and second flapper members pivotally mounted within the housing for movement relative to the axis thereof from an open to a grasping position. In the grasping position the flapper members are disposed substantially perpendicularly to the interior surface of the housing. Each of the flappers is provided with a cutout portion which registers to define an opening therebetween, the opening between said flapper members having a dimension less than the outer diameter of a tubular member to be retrieved. The edges of the flapper members defining the opening are provided with means for graspingly engaging a tubular member. The flappers are responsive to abutting contact with the tubular member to be retrieved by pivoting toward the open position to permit the tubular member to extend upwardly within the housing for a predetermined axial distance. The flapper members are responsive to a uphole movement of the housing by pivoting toward the grasping position to bring the grasping means into engagement with the exterior surface of the tubular member to graspingly engage the same and maintain grasping engagement therewith as the housing is withdrawn from the well.

24 Claims, 3 Drawing Figures

APPARATUS FOR RETRIEVING A TUBULAR MEMBER FROM A WELL

BACKGROUND OF THE INVENTION

1. Field of the Invention

This invention relates to downhole well tools and, in particular, to an overshot tubing retriever.

2. Description of the Prior Art

For any of a variety of reasons, tubular members may become lodged or otherwise hung up within a well bore. When this occurs, it is necessary that the tubular member, commonly called the "fish", be expeditiously retrieved from the bore so that further drilling operations may continue.

The tubular member may be retrieved by the insertion of a fishing tool adapted to engage the tubular member from the interior surface thereof so that the member may be retracted from the bore. Alternatively, apparatus known in the art as an overshot may be utilized which, when lowered into the bore, receives the tubular member therewithin and operates on that member from the exterior surface thereof so as to either sever a predetermined portion of the tubular member or otherwise engage the same to permit the withdrawal thereof.

There are devices in the art known as "junk catchers" or "junk baskets" which utilize a pivoting arrangement of finger members or the like disposed on the interior of an overshot to retrieve core samples, drill bits, and the like. However, such devices, when the fingers are perpendicular to the interior surface of the overshot, completely close the cross sectional area thereof, and are not adaptable to retrieve axially extending tubular members.

SUMMARY OF THE INVENTION

This invention relates to an overshot-type tubular member retrieving apparatus adapted to engage the exterior surface of a tubular fish to withdraw the same from the well bore. The invention comprises at least one flapper assembly which includes first and second radially opposed flapper members pivotally mounted within a tubular housing for pivotal movement relative to the axis thereof from an open to a grasping position. In the grasping position, the flapper members extend substantially perpendicularly to the interior surface of the housing. Each of the flappers has a cutout portion which, when in the closed position, registers with the other cutout to define a central axial opening exhibiting a dimension less than the outer diameter of the tubular member to be retrieved. The edges of the flapper members are provided with grasping means, such as serrations, adapted to graspingly engage the exterior surface of the tubular membler. Means, such as coiled springs, for biasing the flappers toward the closed position are provided. Furthermore, the flapper assembly includes a centralizer having an inclined guiding surface thereon which is disposed axially beneath the flappers. The flapper assembly is freely rotatable with respect to the interior of the housing, but axially constrained to a limited range of axial movement with respect thereto. To facilitate rotation of such an arrangement, bearings may be provided between the housing and the flapper assembly.

In operation, the overshot housing is lowered into the bore and the upper surface of the tubular member to be retrieved is guided by the inclined surface. The flappers are responsive to the downhole movement of the housing and the abutment of the tubular member to deflect toward the open position to permit the tubular member to be received within the housing. The flappers are also responsive to an uphole movment of the housing by pivoting toward the closed position to bring the grasping means into engagement with the exterior surface of the tubular member to grasp the same.

As an alternative embodiment, means for severing the tubular member may be provided on the flappers in place of the grasping means. Thus, as the flappers move to the closed position, the severing means contact the tubular member and effect a cutting thereof. Of course, an over-shot-type tool embodying the teachings of this invention may provide one or many sets of both grasping and severing flappers, arranged axially within the housing in any predetermined configuration depending upon the situation and with any desired axial spacing therebetween.

BRIEF DESCRIPTION OF THE DRAWINGS

The invention will be more fully understood from the following detailed description thereof taken in connection with the accompanying drawings, which form a part of this specification, and in which.

DESCRIPTION OF THE PREFERRED EMBODIMENT

Figure 1A:
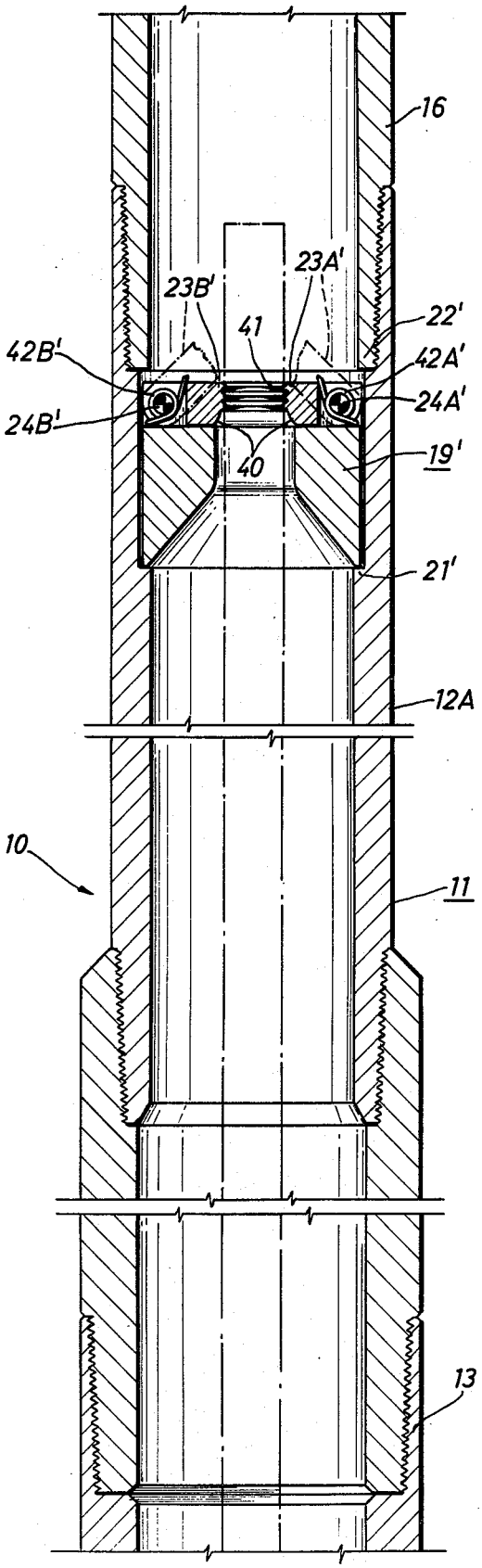
FIGS. 1A and 1B are elevational views, entirely in section, of a tubing retrieving apparatus embodying the teachings of this invention; and, FIG. 2 is a sectional view taken along section lines 2—2 of FIG. 1A.

Throughout the following description, similar reference numerals refer to similar elements in all figures of the drawings.

Figure 1B:
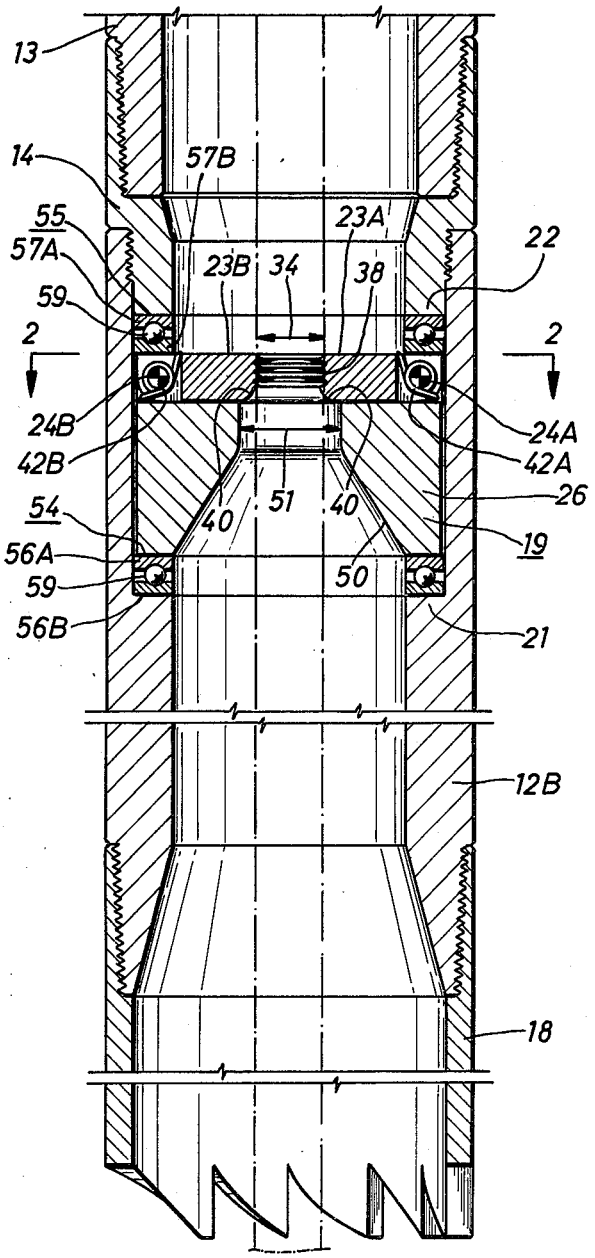

Referring to the Figures, apparatus generally indicated by reference numeral 10 for retrieving a tubular member from a well is shown. It will be understood that the tubular member may be either jointed or continuous tubing. The tubing exhibits a predetermined outer diameter. In the embodiment shown in the figures, the retrieving apparatus 10 includes a housing, or washpipe, generally indicated by numeral 11. The housing 11 may include tubular housing members 12A and 12B threadedly connected by a crossover adapter 13 and a pup joint 14. The housing 11 may be any predetermined axial length. The upper end of the upper housing 12A is threadedly connected, as shown in FIG. 1A, to the lower end of a running string 16. As shown in FIG. 1B, the lower end of the lower housing 12B is threadedly connected to a shoe 18. The shoe 18 is used to clear obstructions, rubble or the like from the annulus between the exterior of the tubular member and the bore casing. It is understood that any substantially elongated hollow member is suitable for use as the tool housing 11 and that the threaded interconnection of the housing members 12A and 12B with the adapter 13 and pup joint 14 is but one of many suitable expedients for providing the housing structure.

In practice, the length of the tubular member to be retrieved may be either a known or unknown quantity. If the length of the tubing to be retrieved is known, it may be advantageous to provide a housing, or washpipe, of sufficient axial length to receive, or "shroud", the member to be retrieved. Alternately, if the length is unknown, the housing may be any convenient length. In either event, utilization of a running string 16 having an internal diameter greater than the external diameter of the member to be retrieved permits any axial length of tubing to be received either within the washpipe or within the interior of the running string 16.

In accordance with the teachings of this invention, at lest one engaging arrangement, or flapper assembly 19, is provided within the interior of the housing, or washpipe, 11. As will be discussed fully herein, the flapper assembly may be provided with either means for grasping or means for severing the tubular member within the bore. Dependent upon factors such as the length of tubing in the bore (if known), the degree to which the tubing is moveable, among other factors, any predetermined number of flapper assemblies, each having either grasping means or severing means thereon, may be disposed at predetermined axial locations along the interior of the washpipe. The axial spacings between the various assemblies is dependent upon the particular situation in which the tool is used.

Accordingly, in FIGS. 1A and 1B, located at predetermined axial locations within the interior of the housing, are lower and upper flapper assemblies 19 and 19'. With only a slight difference, the assemblies 19 and 19' are identical, and therefore, only the lower assembly 19 is described in detail. Corresponding parts of the upper flapper assembly 19' are indicated by a prime numeral designation. It is again emphasized and is to be understood that any predetermined number of flapper assemblies may be provided at axially spaced locations within the housing 11, consistent with the particular application and considerations of structure integrity of the tool 10.

The flapper assembly 19 is dropped into the interior of the housing 11 and is restrained against unlimited axial movement by radially inwardly extending shoulders 21 and 22. The shoulder 21 may be machined into the interior surface of the housing 11. The shoulder 22 is defined by the lower end of the pup joint 14. Those skilled in the art would appreciate that any suitable method of axially restraining the flapper assembly 19 against extended axial movement is within the contemplation of this invention.

The flapper assemblies 19 are each "free-wheeling", i.e., each assembly is rotatable with respect to the interior of the housing 11. As is shown in FIG. 1B, a suitable bearing arrangement (discussed in detail herein) including bearings 54 and 55 may be provided to facilitate the rotation of the assembly with respect to the housing. It is seen from inspection of FIG. 1A that the upper flapper assembly 19' is not mounted on bearings. The assembly 19' is configured to be received between the shoulders 21' and 22' and to be freely rotatable without use of a ball-bearing arrangement. Of course, the assembly is rotatable within the housing to prevent torquing of the tubular member as the washpipe is advanced into the bore to receive the tubing therein.

Figure 2:
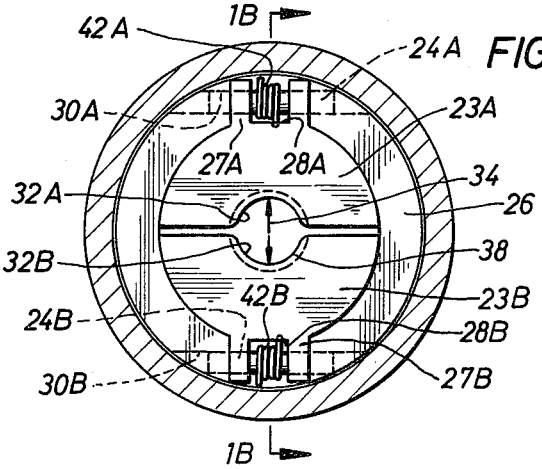

With reference to FIG. 1B and FIG. 2, it may be appreciated that the lower flapper assembly 19 includes first and the second flapper members 23A and 23B, respectively, pivotally mounted by pins 24A and 24B to a centralizer 26. As appreciated, within any flapper assembly 19, any predetermined number of approximately shaped flappers 23 (including a number greater than two flapper members having an angular displacement when viewed in FIG. 2 of less than 180 degrees) may be pinned to the centralizer 26 for pivotal movement with respect to the axis of the housing. As best seen in FIG. 2, each flapper member 23 is a substantially semicircular member having a radially extending flange 27 extending therefrom. Notches 28 are provided within each of the flanges 27 to define a pair of ears on each flapper 23. The pins 24 extend through openings 30 provided within each of the ears to pivotally secure each of the flapper members 23 to the centralizer 26. Each of the flappers 23 are pivotally movable with respect to the axis of the housing from a first, open, to a second, closed, position. In the second, closed, position, illustrated in solid lines in FIGS. 1A and 1B, the flappers 23 extend substantially perpendicularly to the interior surface of the housings with which they are associated. In the open position (indicated for illustrative purposes by dot-dash lines in FIG. 1A), the flapper members 23 define predetermined angles with respect to the interior surface of the housing.

Again it so noted that although illustrated as substantially semicircular in FIG. 2, it is, of course, understood that the flapper members may occupy any predetermined angular portion of the cross sectional area of the interior of the housing. As best viewed in FIG. 2, each flapper member 23 has a cutout portion 32 disposed so as to register with the cutout portion 32 of the opposed flapper member when in the second, closed, position so as to define a substantially centrally aligned opening 34 within the interior of the housing. The opening 34, defined by the registration of the cutout portions 32 provided in the oppositely disposed appropriate flapper members, exhibits a dimension in a plane transverse to the axis of the housing that is less than the outer diametrical dimension of a tubular member to be retrieved. If the tubing is jointed, the opening 34 is dimensioned with respect to the outer diameter of the basic tubing, and not with respect to the joints. Of course, depending upon the outer diameter of the particular tubular "fish" hung up within the bore, flapper members defining the appropriate opening 34 therein are utilized within the washpipe 11.

Each flapper member is provided along the edge of the cutout portions 32 thereof with means 38, such as serrated edges, for grasping a tubular member. Although serrations are illustrated in the Figures, any suitable grasping means known to those skilled in the art may be utilized. The grasping means 38 (as well as severing means, if used on a flapper) are provided along substantially the axial upper half (relative to the axis of the housing) of the edges of the flapper members. A deflecting surface 40 (best illustrated in FIG. 1B) may be conveniently provided and occupies the lower axial portion of the cutout portion 32 provided in each of the flapper members.

Means, such as coiled springs 42A and 42B in FIG. 2, are provided within the notches 28 and are shown as engaged about the pivotal pins 24. The means 42 serve to bias the flapper members 23 toward the second, closed, position.

Included within the flapper assemblies 19 and disposed axially beneath each of the opposed sets of flapper members 23 is the centralizer member 26. The centralizer 26 is, as discussed above, received within and rests between the shoulders 21 and 22 provided as discussed within the housing. The centralizer 26 disposes an inclined guide surface 50 having a predetermined angularity with respect to the axis of the housing. An opening 51 is defined in the centralizer 26 that registers with the opening 34 in the flappers 23. Of course, the opening 51 is dimensioned to permit passage of the joints of the tubular member, if the tubular member to be retrieved is so constructed.

In operation, if it is desired to retrieve a tubular member hung up within the well bore, the retriever apparatus embodying the teachings of this invention is assembled. Depending upon the particular situation under consideration, one, two, or more sets of opposed flapper members exhibiting the appropriate openings 34 and 51 may be provided in axially spaced disposition within the housing 11 and threadedly connected to the lower end of the running string 16.

As the apparatus is lowered into the bore, the shoe 18 may initially contact the tubular member to be retrieved to generally urge the tubular member toward the interior of the housing 11. Continued axial advancement of the apparatus 10 in a downhole direction brings the upper surface of the tubular member into contact with the guiding surfaces 50 on the lowermost centralizer 26. The surfaces 50 act to guide the tubular member to be retrieved so that the axis thereof is coincident with the axis of the housing 11.

As the upper end of the tubular member to be retrieved engages the rounded surfaces 40 of the opposed flappers 23, the flappers respond to the downhole movement of the housing and the abutting engagement of the tubular member to pivotally deflect toward the open position. Similar reactions occur between the other spaced centralizers and opposed flappers if they are provided and the tubular member.

After a predetermined axial length of the tubular member to be retrieved has been received within the overshot (and within the running string if desired), an axially upstring strain is imposed on the running string and the housing. The opposed flappers in each set respond to an uphole or upstring movement of the housing by pivotally deflecting toward the second, closed, position. As the flapper members move toward the closed position, the grasping means 38 engages the exterior surface of the tubular member to securely engage the same.

Depending upon the magnitude of the dimension 34 and the exterior dimension of the tubular member, it may be possible to occasion a severance of a predetermined axial length of the tubular member. To this end, of course, appropriate means 41 for severing a tubular member would be provided in place of the grasping means 38 if a severance is desired. It is understood that it is only for convenience of illustration that the severing means 41 is illustrated in connection with the upper flapper assembly 19'.

With the grasping means 38 in grasping engagement with the exterior surface of the tubular member to be retrieved continued uphole strain on the running string 16 and the housing permits the tubular member to be withdrawn from the bore. If the severing means 41 is used, the uphole strain on the running string 16 would sever the tubular member.

The retrieved fish may be retained in either of two ways. If the flapper assemblies used are of the grasping and the severing type, the fish is retained by the grasping assembly after severance. Alternatively, if grasping assemblies are used solely, local high stresses loading at the point of engagement to rupture the fish and retain the (upper) ruptured portion due to the dimension of the opening 34, which does not allow free downhole passage of the relatively oversized fish.

The bearing members 54 and 55 each include first and second bearing races 56A and 56B and 57A and 57B respectively. The bearings 54 and 55 are respectively located between the lower and upper axial ends of the assembly 19 and the shoulders 21 and 22. Ball members 59 are provided to permit free rotation of the flapper assembly 19 with respect to the housing 11.

It is understood that although those skilled in the art may provide modifications to the embodiment of the invention described hereinabove in view of the teachings of this application, such modifications are within the contemplation of this invention as defined in the appended claims.

What is claimed is:

1. Apparatus for grasping the exterior surface of a tubular member within a well comprising:

a housing;

a centralizer having an inclined guiding surface thereon and an opening therethrough disposed within said housing and rotatable relative thereto;

first and second flapper members, each having a cutout portion therein, pivotally mounted within said centralizer for pivotal movement relative to the axis of said housing between a closed position and an open position, said flapper members in the closed position extending substantially perpendicularly to the interior surface of said housing so that said cutout portions register to define an opening therebetween less than the outer diameter of a tubular member to be grasped, said opening in said flappers axially registering with said opening in said centralizer;

means for graspingly engaging a tubular member from the exterior thereof mounted on the ends of each of said first and second flapper members;

said flapper members being responsive to abutting contact with a tubular member as said housing is moved in a downhole direction by pivoting toward the open position, said flapper members being responsive to movement of said housing in an uphole direction by pivoting toward the closed position to thereby bring said grasping means into engagement with the exterior surface of a tubular member.

2. Apparatus according to claim 1 further comprising means for biasing each of said first and said second flapper members toward the closed position.

3. Apparatus according to claim 1 wherein said grasping means comprises serrations.

4. Apparatus according to claim 1 wherein said grasping means is disposed on the axially upper portion of the ends of said flappers and further comprising a rounded deflecting surface disposed on the axially lower portion of the ends of said flappers.

5. Apparatus according to claim 4 wherein said grasping means comprises serrations.

6. Apparatus for grasping the exterior surface of a tubular member within a well comprising:

a housing;

a first centralizer having an inclined guiding surface thereon and an opening therethrough disposd within said housing and rotatable relative thereto;

first and second flapper members, each having a cutout portion therein, pivotally mounted to said first centralizer for pivotal movement relative to the axis of said housing between a closed position and an open position, said flapper members in the closed position extending substantially perpendicularly to the interior surface of said housing so that said cutout portions register to define an opening therebetween less than the outer diameter of a tubular member to be grasped, said opening in said flappers axially registering with said opening in said first centralizer;

means for graspingly engaging a tubular member from the exterior thereof mounted on the ends of each of said first and second flapper members;

said first and second flapper members being responsive to abutting contact with a tubular member as said housing is moved in a downhole direction by pivoting toward the open position, said flapper members being responsive to movement of said housing in an uphole direction by pivoting toward the closed position to thereby bring said grasping means into engagement with the exterior surface of a tubular member;

a second centralizer having an inclined guiding surface thereon and an opening therethrough disposed within said housing and rotatable thereto, said second centralizer being axially spaced within said housing from said first centralizer;

third and fourth members, each having a cutout portion therein, pivotally mounted to said second centralizer for pivotal movement relative to the axis of said housing from an open to a grasping position, said third and said fourth flapper members in said grasping position extending substantially perpendicularly to the interior surface of said housing so that said cutout portions register to define an opening therebetween less than the outer diameter of a tubular member to be grasped, said opening in said third and fourth flappers axially registering with said opening in said first and second centralizers;

means for graspingly engaging a tubular member from the exterior thereof mounted on the ends of each of said third and said fourth flapper members;

said third and said fourth flapper members being responsive to abutting contact with a tubular member as said housing is moved in a downhole direction by pivoting toward the open position, said third and said fourth flapper members being responsive to movement of said housing in an uphole direction by pivoting toward the closed position to thereby bring said grasping means into engagement with the exterior surface of a tubular member to cooperate with said grasping means on said first and second flapper members to grasp a tubular member.

7. Apparatus according to claim 5 further comprising means for biasing said third and said fourth flapper members toward said closed position.

8. Apparatus according to claim 6, wherein said grasping means are disposed on the axially upper portions of the ends of each of said first, second, third and fourth flappers, and further comprising a rounded deflecting surface disposed on the axially lower portion of the ends of all of said flappers.

9. Apparatus according to claim 8 wherein said grasping means comprises serrations.

10. Apparatus according to claim 6 further comprising means for biasing each of said first and said second flapper members toward the closed position.

11. Apparatus according to claim 6 further comprising means for biasing all of said flapper members toward the closed position.

12. Apparatus according to claim 6 wherein said grasping means is disposed on the axially upper portion of the ends of said first and second flapper members and further comprising a rounded deflecting surface disposed on the axially lower portion of the ends of said first and second flapper members.

13. Apparatus according to claim 6, wherein said grasping means are disposed on the axially upper portions of the ends of each of said third and fourth flapper members, and further comprising a rounded deflecting surface disposed on the axially lower portion of the ends of said third and fourth flapper members.

14. Apparatus according to claim 11 wherein said grasping means comprises serrations.

15. Apparatus for severing a tubular member within a well comprising:

a housing;

a centralizer having an inclined guiding surface thereon and an opening therethrough disposed within said housing and rotatable relative thereto;

first and second flapper members, each having a cutout portion therein, pivotally mounted within said centralizer for pivotal movement relative to the axis of said housing between a closed position and an open position, said flapper members in the closed position extending substantially perpendicularly to the interior surface of said housing so that said cutout portions register to define an opening therebetween less than the outer diameter of a tubular member to be severed, said opening in said flappers axially registering with said opening in the centralizer;

means for severing a tubular member mounted on the ends of each of said first and second flapper members;

said flapper members being responsive to abutting contact with a tubular member as said housing is moved in a downhole direction by pivoting toward the open position, said flapper members being responsive to movement of said housing in an uphole direction by pivoting toward the closed position to thereby bring said severing means into engagement with the exterior surface of a tubular member.

16. Apparatus according to claim 15 further comprising means for biasing each of said first and second flapper members toward the closed position.

17. Apparatus according to claim 15 further comprising means for biasing said third and said fourth flapper members toward said closed position.

18. Apparatus for severing a tubular member within a well comprising:

a housing;

a first centralizer having an inclined guiding surface thereon and an opening therethrough disposed within said housing and rotatable relative thereto;

first and second flapper members, each having a cutout portion therein, pivotally mounted to said first centralizer for pivotal movement relative to the axis of said housing between an open position and a severing position, said flapper members in the severing position extending substantially perpendicularly to the interior surface of said housing so that said cutout portions register to define an opening therebetween less than the outer diameter of a tubular member to be severed, said opening in said flappers axially registering with said opening in said first centralizer;

means for severing a tubular member mounted on the ends of each of said first and second flapper members;

said first and second flapper members being responsive to abutting contact with a tubular member as said housing is moved in a downhole direction by pivoting toward the open position, said flapper members being responsive to movement of said housing in an uphole direction by pivoting toward the severing position to thereby bring said severing means into engagement with the exterior surface of a tubular member;

a second centralizer having an inclined guiding surface thereon and an opening therethrough disposed within said housing and rotatable thereto, said second centralizer being axially spaced within said housing from said first centralizer;

third and fourth flapper members, each having a cutout portion therein, pivotally mounted to said second centralizer for pivotal movement relative to the axis of said housing from an open to a severing position, said third and said fourth flapper members in said severing position extending substantially perpendicularly to the interior surface of said housing so that said cutout portions register to define an opening therebetween less than the outer diameter of a tubular member to be severed, said opening in said third and fourth flapper members axially registering with said opening in said first and second centralizers;

means for severing a tubular member disposed on the ends of said third and said fourth flapper members;

said third and fourth flapper members being responsive to abutting contact with a tubular member as said housing is moved in a downhole direction by pivoting toward the open position, said third and said fourth flapper members being responsive to movement of said housing in an uphole direction by pivoting toward the severing position to thereby bring said severing means into engagement with a tubular member to cooperate with said severing means on said first and second flapper members to sever a a tubular member.

19. Apparatus according to claim 15 wherein said severing means is disposed on the axially upper portion of the ends of said flappers and further comprising a rounded deflecting surface on the axially lower portion of the ends of said flappers.

20. Apparatus according to claim 18, wherein said severing means are disposed on the axially upper portions of the ends of each of said first, second, third and fourth flappers, and further comprising a rounded deflecting surface disposed on the axially lower portion of the ends of all of said flappers.

21. Apparatus according to claim 18 further comprising means for biasing each of said first and second flapper members toward the closed position.

22. Apparatus according to claim 18 further comprising means for biasing all of said flapper members toward the closed position.

23. Apparatus according to claim 18 wherein said severing means is disposed on the axially upper portion of the ends of said first and second flapper members and further comprising a rounded deflecting surface disposed on the axially lower portion of the ends of said first and second flapper members.

24. Apparatus according to claim 18, wherein said severing means are disposed on the axially upper portions of the ends of each of said third and fourth flapper members, and further comprising a rounded deflecting surface disposed on the axially lower portion of the ends of said third and fourth flapper members.

* * * * *

UNITED STATES PATENT AND TRADEMARK OFFICE

CERTIFICATE OF CORRECTION

PATENT NO. : 4,157,199

DATED : June 5, 1979

INVENTOR(S) : Robert C. Klingman

It is certified that error appears in the above-identified patent and that said Letters Patent are hereby corrected as shown below:

Column 1, line 55, "membler" should read --member--.
Column 3, line 6, "lest" should read --least--.
Claim 6, line 36 (column 7, line 21), after "fourth" insert --flapper--.
Claim 7, line 1 (column 7, line 48), delete "5" and insert --6--.
Claim 17, line 1 (column 8, line 43), delete "15" and insert --18--.
Claim 18, line 51 (column 9, line 28), after "and" insert --said--.

In Column 8, Claim 17 should be renumbered to read Claim 19.

In Column 10, Claim 19 should be renumbered to read Claim 17.

Signed and Sealed this

*Twenty-fifth* Day of *December 1979*

[SEAL]

*Attest:*

SIDNEY A. DIAMOND

*Attesting Officer*

*Commissioner of Patents and Trademarks*